US006929134B2

(12) United States Patent
Fujita

(10) Patent No.: US 6,929,134 B2
(45) Date of Patent: Aug. 16, 2005

(54) HEAT TREATMENT DEVICE FOR SYNTHETIC FIBER FILAMENT YARNS

(75) Inventor: Atsuhisa Fujita, Tokyo (JP)

(73) Assignee: Toyo Electric Co., Ltd. (JP)

( * ) Notice: Subject to any disclaimer, the term of this patent is extended or adjusted under 35 U.S.C. 154(b) by 0 days.

(21) Appl. No.: 10/490,075

(22) PCT Filed: Sep. 27, 2002

(86) PCT No.: PCT/JP02/10027

§ 371 (c)(1),
(2), (4) Date: Mar. 17, 2004

(87) PCT Pub. No.: WO03/031701

PCT Pub. Date: Apr. 17, 2003

(65) Prior Publication Data

US 2004/0238518 A1 Dec. 2, 2004

(30) Foreign Application Priority Data

Oct. 5, 2001 (JP) ..... 2001-310631

(51) Int. Cl.[7] ..... D01H 13/28; F27B 9/14; F27B 9/36

(52) U.S. Cl. ..... 213/388; 57/284; 57/290

(58) Field of Search ..... 219/388; 57/282, 57/284, 290; 392/417

(56) References Cited

U.S. PATENT DOCUMENTS 4,301,358 A * 11/1981 Venot ..... 219/388
6,026,636 A * 2/2000 Lorenz et al. ..... 57/290

FOREIGN PATENT DOCUMENTS

| | | | |
|---|---|---|---|
| JP | 53-63641 A | | 6/1978 |
| JP | A-11-93027 | | 4/1999 |
| JP | 2000-345440 A | | 12/2000 |
| JP | 2000345440 A | * | 12/2000 |
| JP | 2000-355840 A | | 12/2000 |

* cited by examiner

*Primary Examiner*—Joseph Pelham
(74) *Attorney, Agent, or Firm*—Price, Heneveld, Cooper, DeWitt & Litton, LLP

(57) ABSTRACT

When a heat treatment device for simultaneously heat-treating synthetic fiber filament yarns with saturated steam of heat medium liquid stored in a plurality of closed containers is installed with other devices together, the total height of the installation is lowered than a conventional one in order to reduce the cost of a building for storing these devices. The closed container for saturated steam of heat medium liquid is formed longer in horizontal direction, the heating surface of an outer surface of the closed container is faced downwardly, and the heating surfaces of the closed containers are provided at positions higher than the heat medium liquid level in the boiler so that a boiler for heating the heat medium is not necessarily installed in each closed container, thereby manufacturing costs are also reduced.

13 Claims, 10 Drawing Sheets

HEAT TREATMENT DEVICE FOR SYNTHETIC FIBER FILAMENT YARNS

TECHNICAL FIELD

This invention relates to a heat treatment device for heating synthetic fiber filament yarns at a uniform temperature throughout the full length of the filament yarns by utilizing characteristics of saturated steam of heat medium liquid. More particularly, the present invention relates to a heat treatment device for synthetic fiber filament yarns installed as one of constituent parts of a drawing and texturing (false-twisting) device for thermoplastic synthetic fiber filament yarns such as polyester or polyamide that are fed from a filament yarn feeder and are under traveling, together with other constituent parts.

BACKGROUND ART

Conventionally, in a heat treatment device for synthetic fiber filament yarns that is to be installed as one of constituent parts of a drawing and texturing device for thermoplastic synthetic fiber filament yarns together with other constituent parts and that utilizes characteristics of saturated steam of heat medium liquid, it has been required due to said characteristics to provide a boiler for heating the heat medium liquid and said boiler is disposed below a closed container of the saturated steam, and also a heating surface facing the filament yarns and having a length corresponding to that of the filament yarns is required in order to heat the filament yarns at a predetermined temperature during traveling. Therefore, the closed container of the saturated steam is formed necessarily longer in vertical direction as described in JP-A-11-93027, for example.

This heat treatment device is installed as one of constituent parts of the drawing and texturing device for synthetic fiber filament yarns together with other constituent parts as described above. Consequently, the overall height of the apparatus increases and which makes it difficult to acquire a building in which the apparatus can be installed.

This tendency is remarkable particularly when a feeding speed of the filament yarns is increased to increase the heating capacity to heat the synthetic fiber filament yarns.

To reduce the height of the building in which the heat treatment device for the synthetic fiber filament yarns is installed, on the one hand, it may be conceivable to form the closed container constituting a chamber of the saturated steam to be longer in horizontal direction as a whole and to arrange its heating surface to face downwardly. According to such a construction, however, since the condensed liquid of the synthetic fiber builds up on the bottom surface neighboring to the heating surface and inside the closed container of the saturated steam, heating of the synthetic fiber by the saturated steam is impeded.

In the above-mentioned heat treatment device, a boiler is installed for each additional closed container. Therefore, when the number of the closed containers is increased to increase the capacity, the number of the boilers must be increased correspondingly and the cost increases as much.

In the heat treatment device for synthetic fiber filament yarns by utilizing the characteristics of the saturated steam of the heat medium liquid described above, it is an object of the present invention to make the height of the closed container constituting the heat treatment device smaller than the full length of the closed container so that the height of a building for accommodating overall devices is lowered when the heat treatment device is installed together with other devices, thereby making it easier to acquire the building for this purpose.

It is another object of the present invention to make it unnecessary to increase correspondingly the number of boilers for heating a heat medium liquid inside a closed container when the number of the closed container is increased to increase the capacity, thereby reducing the cost for additional boilers.

It is still another object of the present invention to make it easy to thread synthetic fiber filament yarns by handwork onto a heating surface of a closed container constituting the heating device described above.

DISCLOSURE OF THE PRESENT INVENTION

In a heat treatment device for synthetic fiber filament yarns in which a closed container of saturated steam of the heat medium liquid is communicated with a boiler for a heat medium liquid and a heating surface is formed on an outer surface of the closed container, a heat treatment device according to the present invention has a construction in which the closed container is formed into a laterally extended form, its heating surface is faced downwardly below the closed container, and a heat medium liquid surface inside the boiler for the heat medium liquid is arranged at a position lower than the heating surface of the closed container.

In the heat treatment device for synthetic fiber filament yarns according to the present invention, a plurality of laterally extended closed containers are disposed in spaced parallel with one another, one of the ends of each laterally extended closed containers is connected to one another through a communication pipe, the other end of each of the laterally extended closed containers is connected to one another through a header, any portion of the communication pipe is connected to a saturated steam chamber of the boiler storing the heating medium liquid, a heating surface of the laterally extended closed container is arranged to face downwardly, and one of the ends of each laterally extended closed container is arranged at a position lower than the other end so that the closed containers are inclined.

BEST MODE FOR CARRYING OUT THE PRESENT INVENTION

Figure 1:
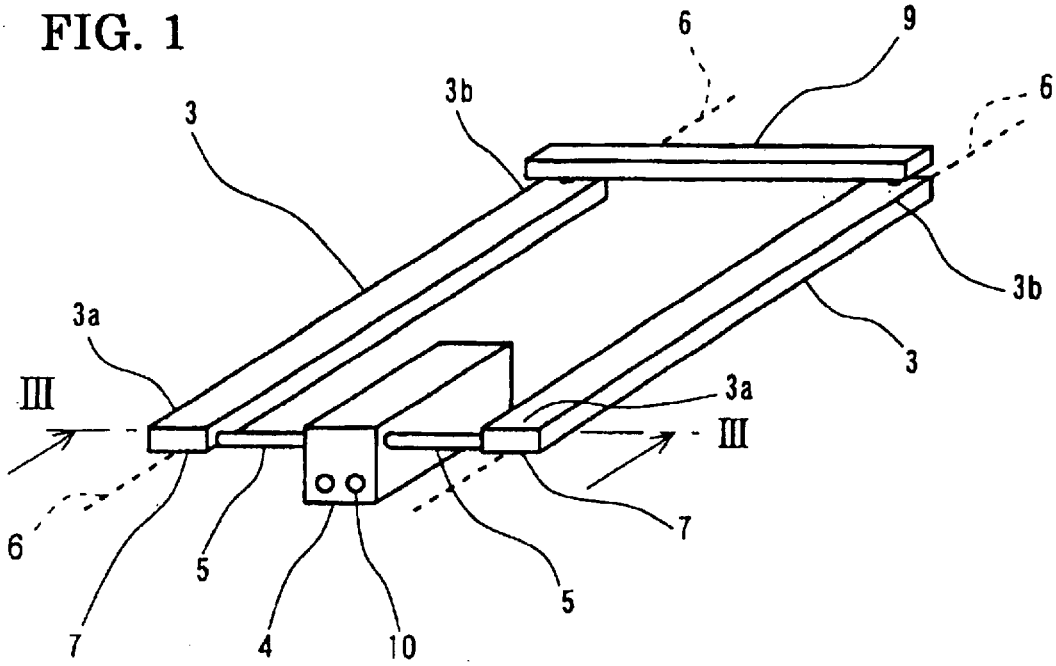
FIG. 1 is a perspective view of a heat treatment device showing an embodiment of the present invention.
Figure 2:
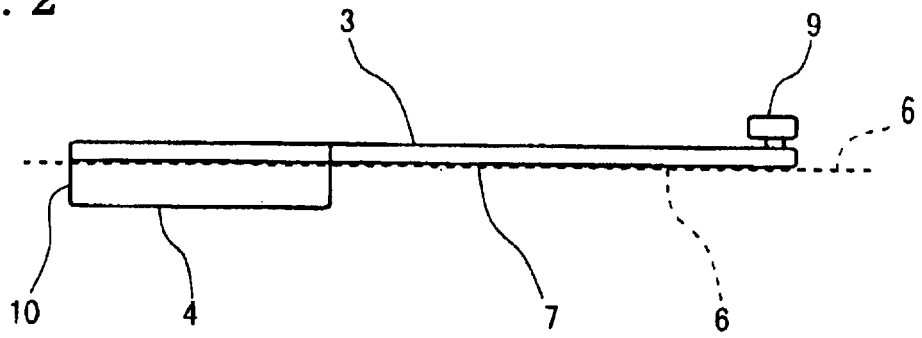
FIG. 2 is a right-hand side view of FIG. 1.

The most preferred embodiment for carrying out the present invention is shown in FIGS. 1 to 4. A laterally extended closed container 3 for storing saturated steam 2 of heat medium liquid 1 is communicated with a boiler 4 for heating the heat medium liquid 1 through a communication pipe 5, a heating surface 7 for synthetic fiber filament yarns 6 is arranged on the laterally extended closed container 3 to face downwardly, and a heat medium liquid surface 8 of the heat medium liquid 1 inside the boiler 4 is arranged at a position lower than the heating surface 7 of the closed container 3.

The closed container 3 is made of a metal material. The communication pipe 5 described above communicates one end 3*a* of the closed container 3 with the saturated steam 2 inside the boiler 4. When a plurality of closed containers 3 are disposed in spaced parallel with one another as shown in FIG. 1, the other end 3*b* of each closed container 3 is connected to one another by use of a header 9.

For the heat medium liquid 1 inside the boiler 4, "DOWTHERM" (a product of The Dow Chemical Company, US) which has been of a widespread use in the past or other organic solvents are used and the heat medium liquid 1 is heated by a heater 10 inside the heat medium liquid 1.

Thus, the heat medium liquid 1 is heated by the heater 10 inside the boiler 4, and saturated steam 2 at a saturation temperature that is set in advance corresponding to a saturation pressure is generated above the heat medium liquid surface 8 inside the boiler 4 and inside both communication pipe 5 and closed container 3. Latent heat of this saturated steam 2 heats the filament yarns 6 of the synthetic fiber placed on the heating surface 7 which is formed on the closed container 3 and faced downwardly, to a predetermined temperature, thereby heat-treating the filament yarns 6.

During heating of the filament yarns 6, the saturated steam 2 is liquefied into a condensed heat medium due to consumption of the latent heat of the saturated steam 2 while keeping the predetermined temperature, flows down into the boiler 4 positioned at the lower level than the heating surface 7 of the closed container 3, is thereby heated again by the heater 10, changes to the saturated steam 2 and is supplied into the closed container 3.

Figure 14:
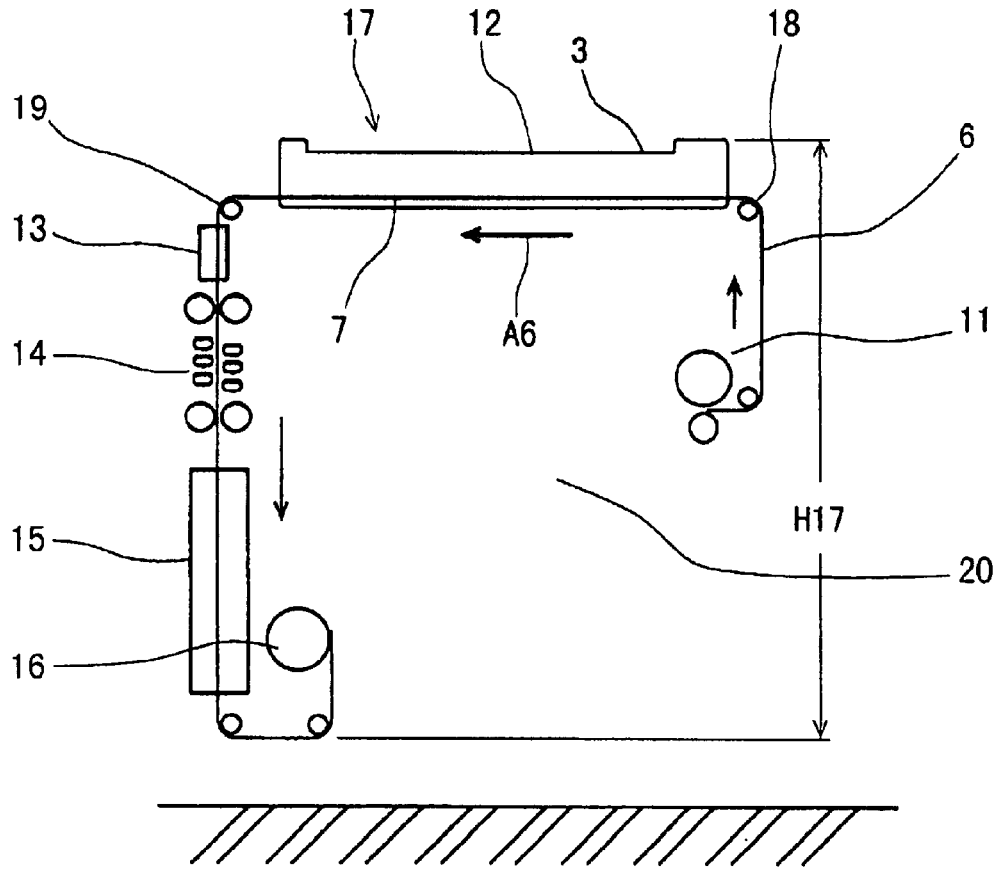
FIG. 14 is a side view of an overall arrangement of the heat treatment device of the present invention.

Referring to FIG. 14, in a drawing and texturing (false-twisting) device 17 for serially heating filament yarns 6 of synthetic fiber, the filament yarns 6 are supplied from a filament yarn feeder 11, heated by a pre-stage heater 12, cooled by a cooling plate 13, processed by a drawing and texturing part 14, heated by a post-stage heater 15 for heat setting, and taken up onto a reeler 16. The heat treatment device according to the embodiment of the present invention is arranged as the pre-stage heater 12 above a space 20 between a guide roll 18 on the side of the filament yarn feeder 11 and a guide roll 19 in proximity of the cooling plate 13, and the heating surface 7 of the laterally extended closed container 3 is faced downwardly.

In this instance, while the filament yarns 6 are under traveling in the lengthwise direction A6 along the downwardly-faced heating surface 7 of the closed container 3 according to the embodiment of the present invention, the filament yarns 6 are heat-treated by latent heat of the saturated steam throughout their entire length, and the saturated steam losing the latent heat is liquefied while a predetermined temperature is maintained.

The liquefied heat medium liquid returns to the heat medium liquid 1 inside the boiler 4 through the communication pipe 5 towards the heat medium liquid surface 8 inside the boiler 4 arranged at the position lower than the heating surface 7 as shown in FIG. 3, and again heated there by the heater 10, changes into the saturated steam 2, fills the inside of the closed container 3, brings the saturated steam 2 into direct contact with the inside of the heating surface 7 of the closed container 3 and always heats the heating surface 7 from inside by the saturated steam 2.

Figure 24:
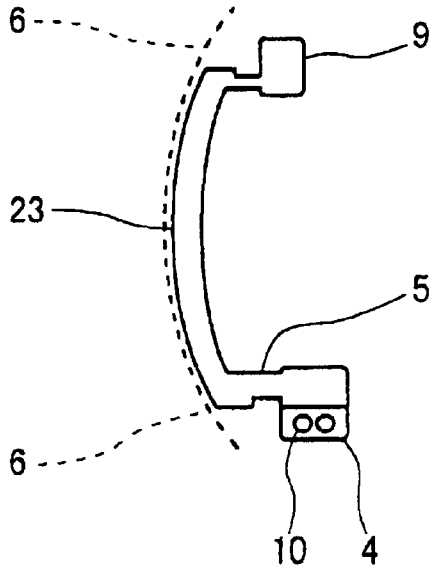
FIG. 24 PRIOR ART
FIG. 24 is a side view of a heat treatment device according to the prior art.
Figure 25:
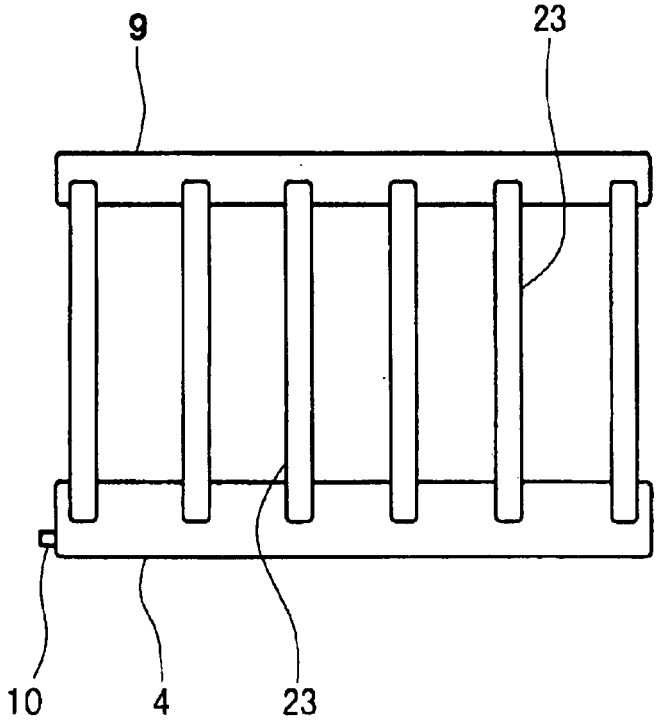
FIG. 25 PRIOR ART
FIG. 25 is a front view of FIG. 24.
Figure 26:
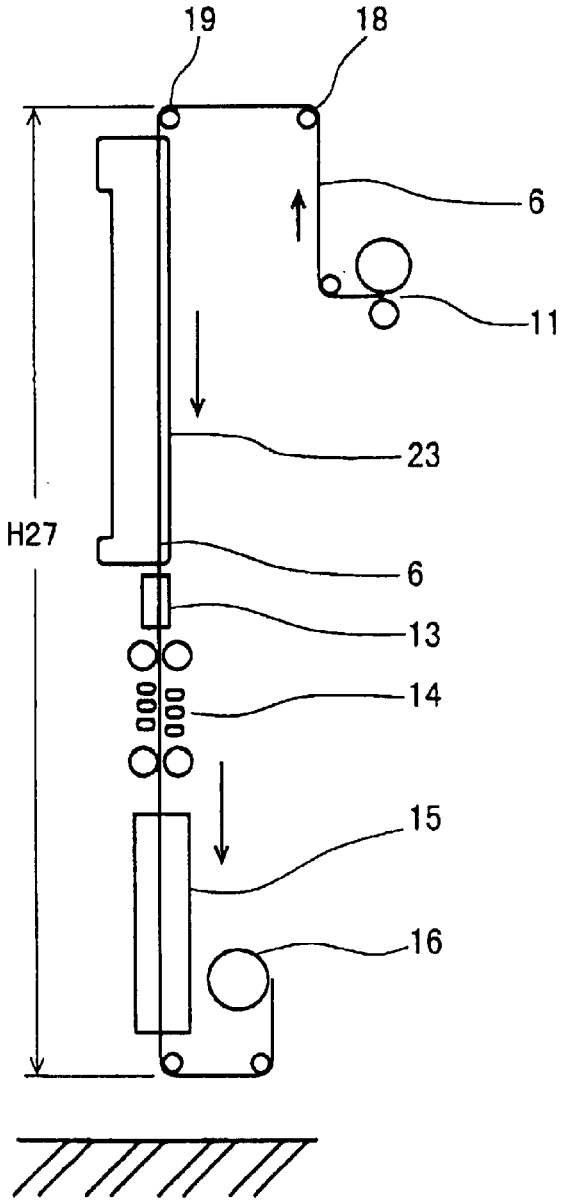
FIG. 26 PRIOR ART
FIG. 26 is a side view of an overall setup when the heat treatment device according to the prior art is arranged.

As described above, because this heating device is constituted by use of one or more of the laterally extended closed containers 3, the heat treatment device can be arranged horizontally above the space 20 between the filament yarn feeder 11 and the cooling plate 13 as shown in FIG. 14, and the overall height H17 of the drawing and texturing device in this case can be drastically reduced in comparison with the overall height H27 shown in FIG. 26 where the vertically extended closed container 23 of the prior art shown in FIGS. 24 and 25 is installed over the cooling plate 13.

In addition, because the heating surface 7 of the laterally extended closed container 3 is made to face downwardly, when the heat treatment device of the present invention is installed as shown in FIG. 14, the heating surface 7 is open to the space 20, so that an operator can enter the space 20 and can easily do necessary works when the filament yarns 6 are to be threaded along the heating surface 7 and when breakage of the filament yarns is to be mended.

Figure 3:
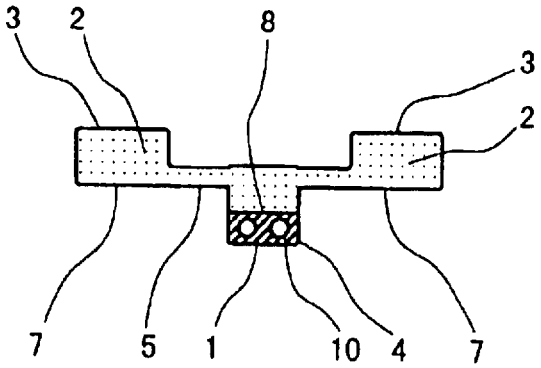
FIG. 3 is a sectional view taken along the line III—III of FIG. 1.
Figure 4:
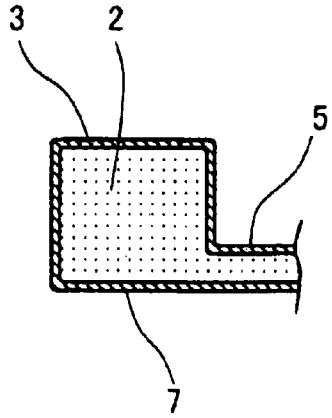
FIG. 4 is an enlarged sectional view of a part of FIG. 3.

Furthermore, because the heat medium liquid surface 8 of the boiler 4 is arranged at the position lower than the heating surface 7 of the closed container 3 as shown in FIG. 3, the condensation of the saturated steam 2 of the heat medium liquid 1, which is generated from heat-treatment of the filament yarns 6 by the saturated steam 2 inside the closed container 3, flows down naturally due to its own weight into the boiler 4 which is arranged at the position lower than the heating surface 7.

The embodiment of the present invention is as described above but is not particularly limited thereto, and the present invention can be executed by changing partially its construction and its arrangement or making addition thereto.

Figure 5:
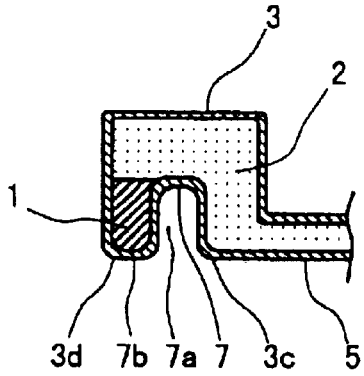
FIG. 5 is a sectional view showing another embodiment of the present invention different from FIG. 4.

For example, while the heating surface 7 of the closed container 3 shown in FIGS. 1 to 4 is shaped into the planar shape, it is possible to form a groove 7*a* opening downwardly by means of protrusions 3*c* and 3*d* at the heating surface 7 of the closed container 3 as shown in FIG. 5 instead of forming the above-mentioned planar shape. In this case, the condensation of the heat medium liquid 1 described above stays inside an upward groove 7*b* which is formed inside the closed container 3, wherein the upward groove 7*b* is adjacent to the downward groove 7*a* and the upward groove 7*b* is on the opposite side from the boiler 4 with reference to the downward groove 7*a*. However, the condensation of the heat medium liquid 1 is heated by the saturated steam 2 and the predetermined temperature is kept.

Figure 6:
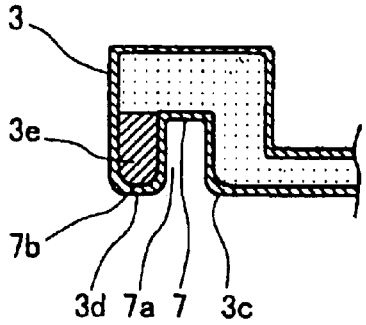
FIG. 6 is a sectional view showing another embodiment of the present invention different from FIG. 5.
Figure 7:
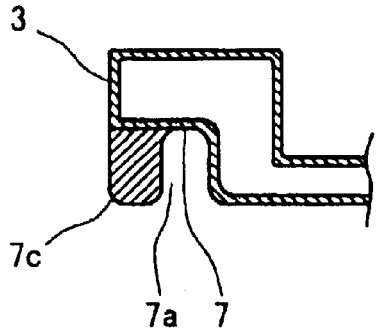
FIG. 7 is a sectional view showing another embodiment of the present invention different from FIG. 6.
Figure 8:
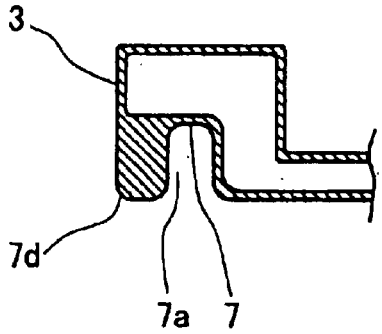
FIG. 8 is a sectional view showing another embodiment of the present invention different from FIG. 7.

The condensation of the heat medium liquid 1 remains and stays inside the upward groove 7*b* adjacent to the downward groove 7*a* as described above. To prevent the condensed heat medium liquid 1 from entering the upward groove 7*b*, it is possible to pack a molten material 3*e* into the upward groove 7*b* as shown in FIG. 6. Also, it is possible to integrally form a protrusion 7*c* at the heating surface 7 by using the same material as that of the closed container 3 as shown in FIG. 7, or to integrally form a protrusion 7*d* with the heating surface 7 through molding as shown in FIG. 8, so that either the protrusions 7*c* or 7*d* and the closed container 3 together form the downward groove 7*a* between them.

Figure 9:
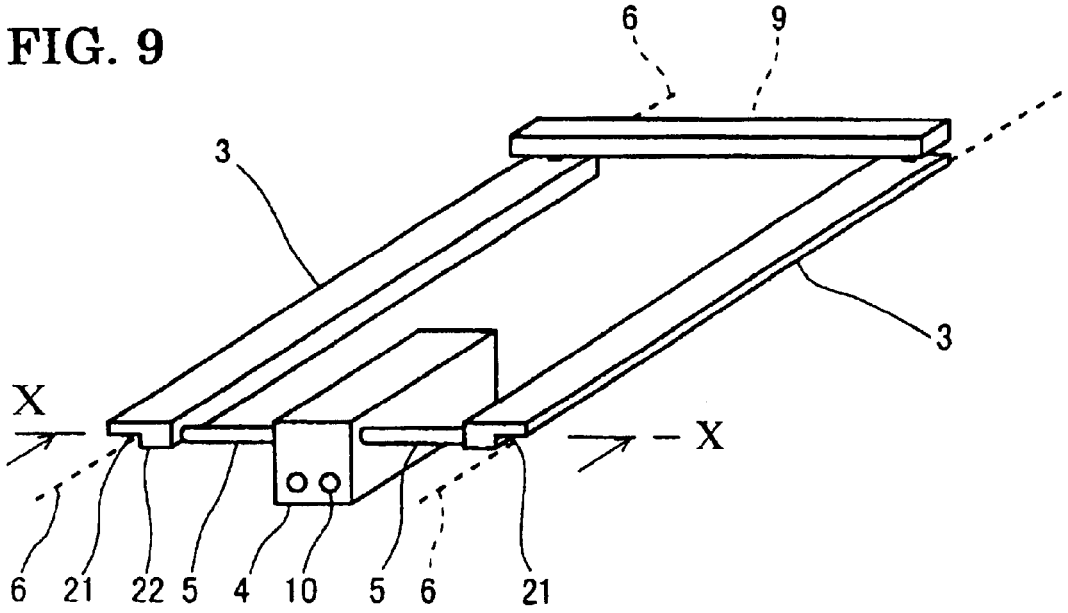
FIG. 9 is a perspective view showing another embodiment of the present invention different from FIG. 1.
Figure 10:
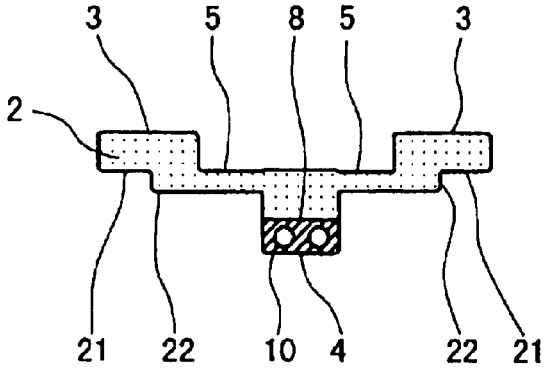
FIG. 10 is a sectional view taken along the line X—X of FIG. 9.
Figure 11:
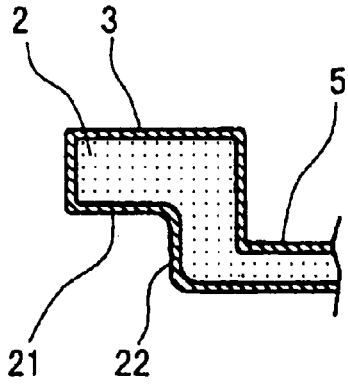
FIG. 11 is an enlarged sectional view of a part of FIG. 10.

Also, as shown in FIGS. 9 to 11, it is possible to form the flat surface 21 and the protrusion 22 downwardly, wherein the protrusion 22 is closer to the boiler 24 than the flat surface 21, instead of forming the downward groove 7*a* at the heating surface 7 of the closed container 3.

Figure 12:
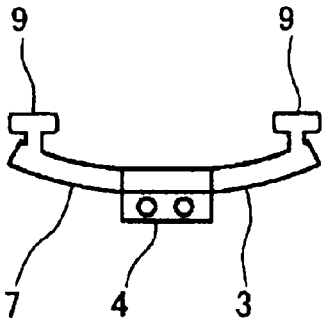
FIG. 12 is a right-hand side view showing another embodiment of the present invention different from FIG. 2.
Figure 13:
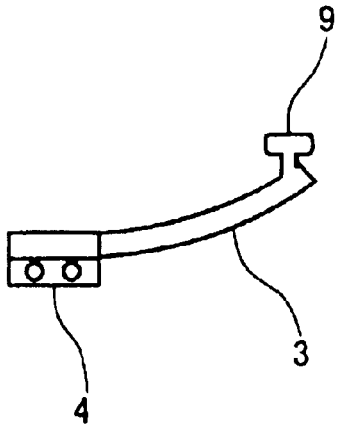
FIG. 13 is a right-hand side view showing another embodiment of the present invention different from FIG. 12.

Furthermore, it is possible to provide one or three or more laterally extended closed containers 3 in place of the two closed containers 3 of FIG. 1, or to form the laterally extended closed container 3 and its heating surface 7 into a curved shape facing downwardly and to dispose the boiler 4 at the lowest position of the center of the heating surface 7 and the headers 9, 9 at both ends as shown in FIG. 12, or to dispose the boiler 4 at the lowest position at one of the ends of the laterally extended closed container 3 having a downwardly protruding curved shape and the header 9 at the other end as shown in FIG. 13.

As described above, in the heat treatment device according to the present invention, the closed container 3 for the saturated steam 2 of the heat medium liquid 1 is formed into the laterally extended shape, its heating surface 7 is faced downwardly and the heat medium liquid surface 8 inside the boiler 4 for the heat medium liquid is arranged at the position lower than the heating surface 7. Therefore, when the heat treatment device is disposed over the drawing and texturing (false-twisting) device 17 for the synthetic fiber, the heat medium liquid 1 does not linger around the inside of the heating surface 7 but naturally flows down into the boiler 4 even when the closed container 3 is arranged in the laterally extended form, as a result the heating surface 7 can be always heated by the saturated steam 2 inside the boiler 4.

In the heat-treatment devices according to the prior art that use the saturated steam of the heat medium, it has been believed impossible to form the closed container 3 into the laterally extended form. However, the present invention enabled to provide the closed container 3 which is formed longer in horizontal direction. And the heat treatment device of the present invention is not limited by the height of a chamber which accommodates the heat treatment device even when the entire length of the heat treatment device is increased in order to increase a filament yarn feeding speed.

According to the present invention, because the heating surface 7 of the laterally extended closed container 3 is faced downwardly, when the closed container 3 is arranged over other devices of the drawing and texturing (false-twisting) device 17, the space 20 can be defined below the heating surface 7. Therefore, the operator can enter the space 20 and can easily do necessary works to thread the filament yarns 6 of the synthetic fiber onto the heating surface 7 or to mend the breakage of the filament yarns.

The most preferred embodiments for carrying out the present invention are not limited to those shown in FIGS. 1 to 14 described above but others also exist.

Figure 15:
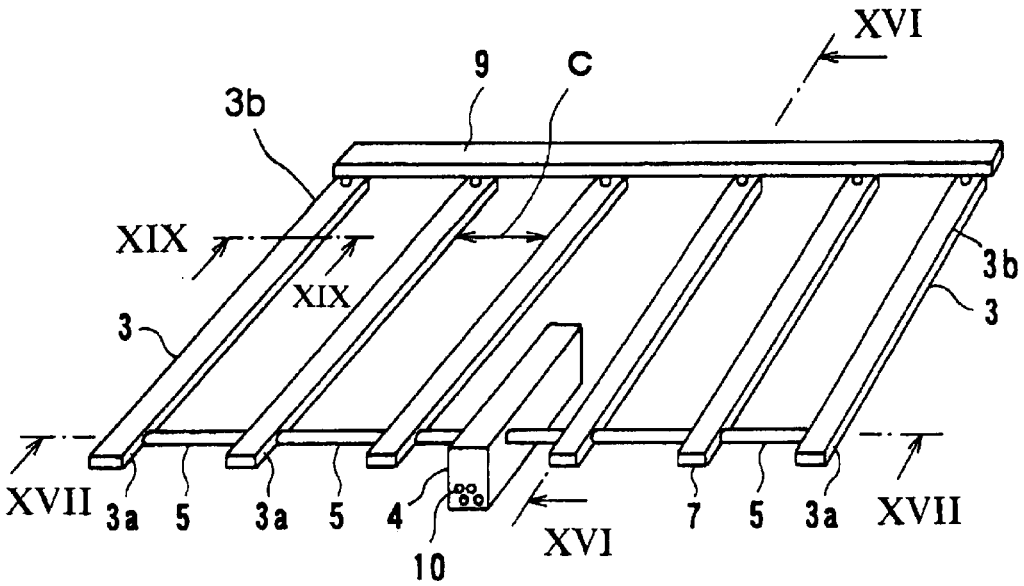
FIG. 15 is a perspective view of a heat treatment device showing another embodiment of the present invention different from those shown in FIGS. 1 to 14.
Figure 16:
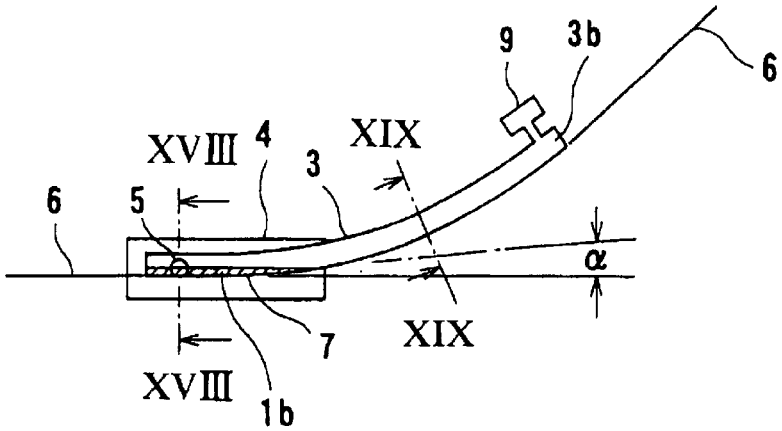
FIG. 16 is a sectional view taken along the line XVI—XVI of FIG. 15.
Figure 17:
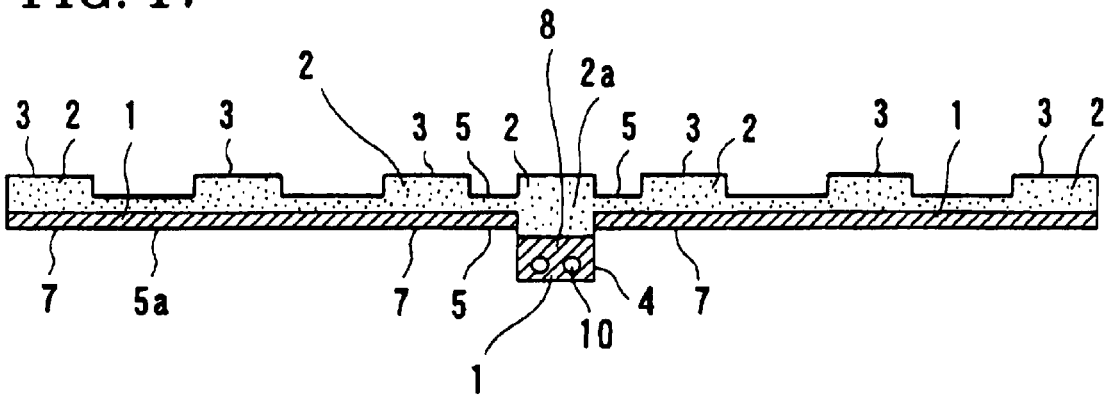
FIG. 17 is an enlarged sectional view taken along the line XVII—XVII of FIG. 15.
Figure 18:
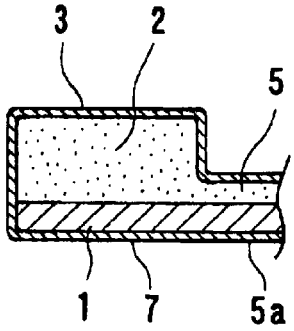
FIG. 18 is an enlarged sectional view taken along the line XVIII—XVIII of FIG. 16.
Figure 19:
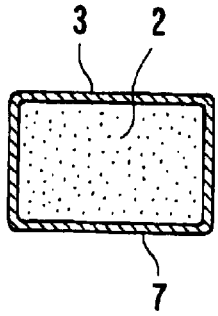
FIG. 19 is an enlarged sectional view taken along the line XIX—XIX of FIGS. 15 and 16.

Other embodiments are shown in FIGS. 15 to 23, for example. One end 3*a* of each of a plurality of laterally extended closed containers 3 disposed in spaced parallel with one another with gaps C therebetween is connected to one another through the communication pipe 5, and the heating surface 7 of each laterally extended closed container 3 and the lower surface 5*a* of the communication pipe 5 at each connection portion are arranged at the same height as shown in FIGS. 17 and 18. Further, the other end 3*b* of each laterally extended closed container 3 is connected to one another through the header 9, any portion of the communication pipe 5 is connected to the saturated steam chamber 2*a* of the heat medium liquid 1 inside the boiler 4, the heating surface 7 of each closed container 3 is arranged to face downwardly, and one end 3*a* of each laterally extended closed container 3 is arranged at the position lower than the other end 3*b* so that the closed containers 3 can be inclined at an inclination of $\alpha$ as a whole.

The above-described laterally extended closed container 3 is somewhat curved in such a fashion as to protrude downwardly with respect to the lateral direction, and the heating surface 7 of the curved closed container 3 is formed into the flat surface. The yarns of filament yarns 6 of the synthetic fiber to be heat-treated are arranged face to face with the heating surface 7 along the longitudinal direction of the heating surface 7

For the heat liquid medium 1 inside the boiler 4, "DOWTHERM" (a product of The Dow Chemical Company, US) that has been of a widespread use in the past and other organic solvents are used. The heater 10 inside the heat liquid medium 1 heats the heat liquid medium 1, and the heat liquid medium 1 changes into saturated steam 2 and fills the saturated steam chamber 2*a* inside the boiler 4.

The saturated steam 2 of the heat medium liquid 1 filling the saturated steam chamber 2*a* flows into the closed container 3 through the communication pipe 5 connected to the saturated steam chamber 2*a* and into other closed containers 3, and latent heat of the saturated steam 2 heats the filament yarns 6 of the synthetic fiber facing the heating surface 7 of the closed container 3 to a predetermined temperature and heat-treats the filament yarns 6.

During heating of the filament yarns 6, as latent heat of the saturated steam 2 is consumed, the saturated steam is liquefied while keeping the predetermined temperature and changes into the condensation of the heat medium liquid 1. The condensation of the heat medium liquid 1 flows down to the inside of the heating surface 7 of the closed container 3, further flows down towards the one end 3*a* which is at the position lower than the other end 3*b* of the closed container 3, and forms a condensation layer 1*b* at one end 3*a*, and further flows into the lower surface 5*a* of the communication pipe 5 positioned at the same height as the one end 3*a* of the closed container 3, and then further flows into the heat medium liquid surface 8 of the heat medium liquid 1 inside the boiler 4 as shown in FIG. 17, wherein the heat medium surface 8 is at the lower position than the lower surface 5*a*, and is again heated and converted into the saturated steam 2 by the heater 10. The saturated steam 2 thus formed is then supplied into each closed container 3 and consecutively heat-treats the filament yarns 6 while they are under traveling in the same way as described above.

The heat treatment device according to this embodiment of the present invention is installed with other devices as shown in FIG. 14 in the same way as those explained with reference to FIGS. 1 to 13. In a drawing and texturing (false-twisting) device 17 for serially heating the filament yarns 6 of the synthetic fiber, the filament yarns 6 are supplied from a filament yarn feeder 11, heated by a pre-stage heater 12, cooled by a cooling plate 13, processed by a drawing/texturing (false twisting) part 14, heated by a post-stage heater 15 for heat-setting and taken up onto a reeler 16. The heat treatment device according to this embodiment of the present invention is arranged as the pre-stage heater 12 above the space 20 between a guide roll 18 on the side of the filament yarn feeder 11 and a guide roll 19 in proximity of the cooling plate 13, and the heating surfaces 7 of the laterally extended closed containers 3 are faced downwardly.

In this case, since one end 3*a* of each of the closed containers 3 according to the embodiment of the present invention is arranged at the position lower than the other end 3*b*, the condensation of the saturated steam 2 of the heat medium liquid 1, which is generated when the filament yarns 6 are hearted by the saturated steam 2 inside the closed container 3, flows down naturally from the other end 3*b* of the closed container 3 toward its one end 3*a* due to its own weight, and at the one end 3*a* the condensation forms the heat medium condensation layer 1*b* as shown in FIG. 16. In consequence, the saturated steam 2 comes into direct contact with the inside of the upper half portion of the heating surface 7 and heats the same.

The present invention is represented by the embodiments as described above, but the present invention can be executed by partially changing the construction or the arrangement of the embodiments or by making addition thereto.

Figure 20:
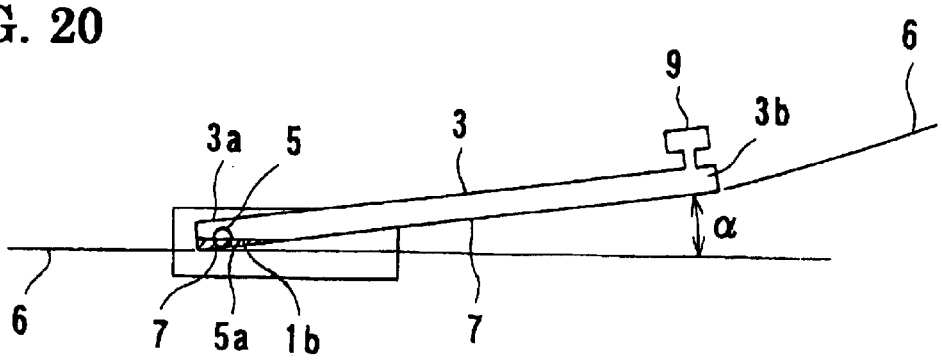
FIG. 20 is a right-hand side view showing another embodiment of the present invention different from FIG. 16.

For example, it is possible to form the closed container 3 into a linear shape in its lengthwise direction with an inclination of $\alpha$ such that one end 3*a* of the closed container 3 is at a position lower than the other end 3*b* as shown in FIG. 20.

Figure 21:
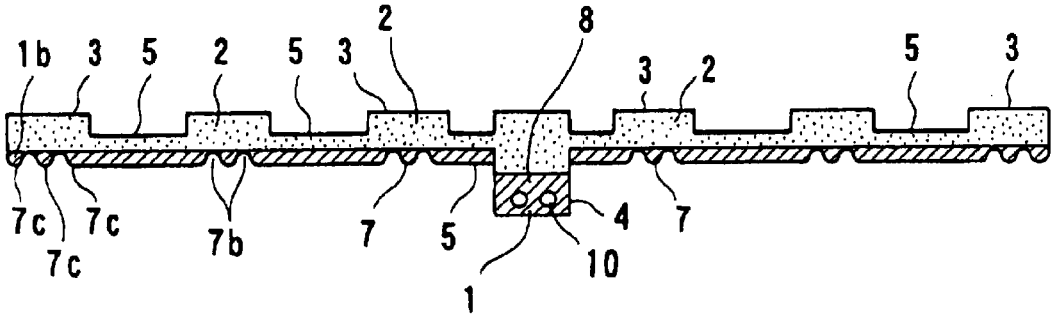
FIG. 21 is a sectional view showing another embodiment of the present invention different from FIG. 17.
Figure 22:
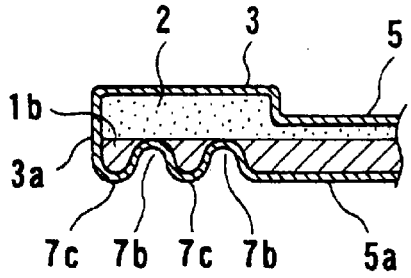
FIG. 22 is an enlarged sectional view of a part of FIG. 21.
Figure 23:
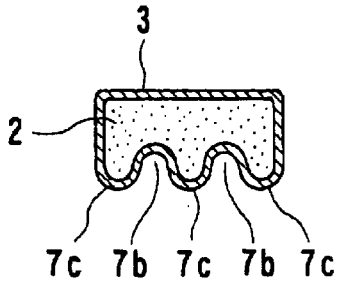
FIG. 23 is an enlarged sectional view of a part of FIG. 21, corresponding to FIG. 19

Also, while the heating surfaces 7 of the closed containers 3 shown in FIGS. 15 to 20 are shaped into the planar shape, it is possible to form two grooves 7*b* opening downwardly by means of protrusions 7*c* formed at the heating surface 7 of the closed container 3 as shown in FIGS. 21 to 23 instead of forming the heating surface 7 into the planar shape. In this case, the condensation layer 1*b* described above remains in the protrusions 7*c* close to one end 3*a* of the closed container 3 shown in FIGS. 21 and 22, but this condensation layer 1*b* keeps the direct contact with the saturated steam 2 and therefore the predetermined temperature is maintained.

In each of the heat treatment devices shown in FIGS. 15, 17 and 21, the same number of the laterally extended closed containers 3 and the communication pipe 5 are connected on both right and left sides of the boiler 4, but this number can be set differently between the right and the left sides of the boiler 4.

In the heat treatment device according to the present invention, one end 3*a* of each of a plurality of laterally extended closed containers 3 is connected to one another through the communication pipe 5, the heating surface 7 of each laterally extended closed container 3 and the lower surface of the communication pipe 5 at the connecting portion thereof are arranged at the same height as shown in FIG. 16, any portion of the communication pipe 5 is connected to the saturated steam chamber 2*a* of the boiler 4 storing the heat medium liquid 1, the heating surface 7 of each laterally extended closed container 3 is arranged to face downwardly and the one end 3*a* of each laterally extended closed container 3 is arranged at the position lower than the other end 3*b* so that each closed container 3 is inclined. Therefore, when the heat treatment device is installed together with other devices, the height of a building for accommodating overall devices can be reduced so that the building for this purpose can be easily acquired.

Since the heat treatment device according to the present invention is as described above, when the heat treatment device is installed above the drawing and texturing device 17 for the synthetic fiber, the condensation of the heat medium liquid 1 generated inside the closed container 3 does not stay inside the heating surface 7 of each laterally extended closed container 3 but naturally flows down into the boiler 4 even when the closed containers 3 are arranged in the laterally extended arrangement. Therefore, the heater 10 inside the heat medium liquid 1 can always heat the heat medium liquid 1 inside the boiler 4.

When the number of the closed containers is increased so as to increase the capacity in the heat treatment device according to the present invention, the number of the boilers 4 for heating the heat medium liquid inside the closed container need not be increased correspondingly to the increment of the number of the closed containers. Therefore, the cost for this purpose can be made economical.

In the present invention, the heating surface 7 of each laterally extended closed container 3 is faced downwardly. When the closed container 3 is installed above other devices of the drawing and texturing device 17, the space 20 can be defined below the heating surface. Therefore, an operator can easily enter the space 20 in order to thread the filament yarns 6 of the synthetic fiber onto the heating surface 7 or to mend the breakage of filament yarns.

What is claimed is:

1. A heat treatment device for synthetic fiber filament yarns comprising;

a closed container of saturated steam of heat medium liquid, which is shaped into a laterally extended shape, a heating surface which is arranged to face downwardly and constitutes a part of an outer surface of said closed container, and a boiler for heating said heat medium liquid, wherein an inside of said heating surface and an inside of a saturated steam chamber in said boiler are communicated via a communication pipe used for fluid communication of condensed heat medium liquid in common with saturated steam of heat medium liquid, and an inner surface of said heating surface and an inner bottom surface of said communication pipe are arranged at a position higher than a heat medium liquid level inside said boiler along their entire lengths respectively.

2. A heat treatment device for synthetic fiber filament yarns according to claim 1,wherein said heating surface is formed of a laterally extended flat surface along the entire length of said closed container.

3. A heat treatment device for synthetic fiber filament yarns according to claim 1, further comprising:

a longitudinal groove having a heating surface thereof opening downward, wherein said longitudinal groove is formed of the same material as that of said heating surface of said closed container and formed integrally with said heating surface of said closed container along the entire length of said closed container.

4. A heat treatment device for synthetic fiber filament yarns according to claim 3, further comprising:

a longitudinal groove opening downward which is formed of the same material as that of said heating surface of said closed container and formed integrally with said heating surface of said closed container, and an upward groove formed adjacent to said downward opening groove and said upward groove is on the opposite side from said boiler for the beat medium liquid, wherein a molten material of the same material as that of said closed container is filled into said upward groove.

5. A heat treatment device for synthetic fiber filament yarns according to claim 1, further comprising:

a downward projection formed on said heating surface of said closed container on the side adjacent to said boiler, and a downward flat surface formed on said heating surface of said closed container on the opposite side from said boiler, wherein said downward projection and said downward flat surface are formed of the same material as that of said heating surface of said closed container and formed integrally with said heating surface of said closed container.

6. A heat treatment device for synthetic fiber filament yarns according to claim 5, further comprising:

an additional downward protrusion which is fused to said downward flat surface, and a downward opening groove which is defined between said additional downward protrusion and said downward protrusion formed on said heating surface on the side adjacent to said boiler.

7. A heat treatment device for synthetic fiber filament yarns comprising:

at least two closed containers of saturated steam of heat medium liquid, each of them is shaped into a laterally extended shape, and said closed containers are arranged plane-wise, a heating surface of each closed container, each heating surface constitutes a part of an outer surface of each closed container, a boiler which is communicated with each of said closed containers, and a header through which each of said closed containers is communicated with one another, wherein said beating surface of each closed container is set to face downwardly and arranged at a position higher than a heat medium liquid level inside said boiler, wherein an inside of said heating surface and an inside of a saturated steam chamber in said boiler are communicated via a communication pipe used for fluid communication of condensed heat medium liquid in common with saturated steam of heat medium liquid, and an inner surface of said heating surface and an inner bottom surface of said communication pipe are arranged at a position higher than a heat medium liquid level inside said boiler along their entire lengths respectively.

8. A heat treatment device for synthetic fiber filament yarns comprising;

a plurality of laterally extended closed containers which are disposed in spaced parallel with one another with gaps therebetween, a communication pipe through which one end of each of said plurality of laterally extended closed containers is connected to one another, said communication pipe is used for fluid communication of condensed heat medium liquid in common with saturated steam of heat medium liquid, a heating surface of each laterally extended closed container, said heating surface is arranged to face downwardly, a header through which the other end of each of said laterally extended closed containers is connected to one another, a saturated steam chamber of a boiler storing a heat medium liquid, any portion of said communication pipe is connected to said saturated steam chamber, wherein said heating surface of each of said laterally extended closed containers and a lower surface of said communication pipe at a connecting portion thereof are arranged at the same height, and said one end of each of said laterally extended closed containers is arranged at a position lower than the other end so as to incline each of said laterally extended closed containers, and an inner surface of said heating surface and an inner bottom surface of said communication pipe are arranged at a position higher than a heat medium liquid level inside said boiler along their entire lengths respectively.

9. A heat treatment device for synthetic fiber filament yarns according to claim 8, wherein said laterally extended closed containers are formed into a linear shape in a longitudinal direction thereof.

10. A heat treatment device for synthetic fiber filament yarns according to claim 8, wherein said laterally extended closed containers are curved in such a fashion as to define a downward convexity in a longitudinal direction thereof.

11. A heat treatment device for synthetic fiber filament yarns according to claim 8, wherein said heating surface of said closed container is constituted by a laterally extended flat surface.

12. A heat treatment device for synthetic fiber filament yarns according to claim 8, wherein said heating surface of said closed container has a lateral groove opening downward.

13. A heat treatment device for synthetic fiber filament yarns according to claim 8, wherein said heating surface of said closed container has a plurality of lateral grooves opening downward.

* * * * *

UNITED STATES PATENT AND TRADEMARK OFFICE

CERTIFICATE OF CORRECTION

PATENT NO. : 6,929,134 B2
DATED : August 16, 2005
INVENTOR(S) : Atsuhisa Fujita

It is certified that error appears in the above-identified patent and that said Letters Patent is hereby corrected as shown below:

Title page,
Item [57], ABSTRACT,
Line 7, “lowered” should be -- lower --.

Column 7,
Line 37, “hearted” should be -- heated --.

Column 9,
Line 22, “beat” should be -- heat --.
Line 61, “beating” should be -- heating --.

Signed and Sealed this

Seventh Day of March, 2006

JON W. DUDAS
*Director of the United States Patent and Trademark Office*